United States Patent [19]

Dondelewski

[11] 4,127,390

[45] Nov. 28, 1978

[54] HYDRODESULFURIZATION OF COAL AND THE LIKE

[75] Inventor: Michael A. Dondelewski, Grove City, Pa.

[73] Assignee: Coalmet Corporation, Pittsburgh, Pa.

[21] Appl. No.: 827,450

[22] Filed: Aug. 25, 1977

[51] Int. Cl.[2] ..... C10L 9/10; C10B 57/00

[52] U.S. Cl. ..... 44/1 R; 201/17

[58] Field of Search ..... 44/1 R, 4; 201/17

[56] References Cited

U.S. PATENT DOCUMENTS

| | | | |
|---|---|---|---|
| 28,543 | 5/1860 | Nock | 201/17 |
| 1,899,808 | 2/1933 | Kern | 201/17 X |
| 3,252,769 | 5/1966 | Nagelvoort | 44/1 R |
| 3,909,213 | 9/1975 | Sanders | 44/1 R |

*Primary Examiner*—Carl Dees

*Attorney, Agent, or Firm*—Webb, Burden, Robinson & Webb

[57] ABSTRACT

A process for reducing the sulfur content of coal and the like by treatment with an aqueous sodium chloride solution at moderately elevated temperatures and pressures.

4 Claims, 1 Drawing Figure

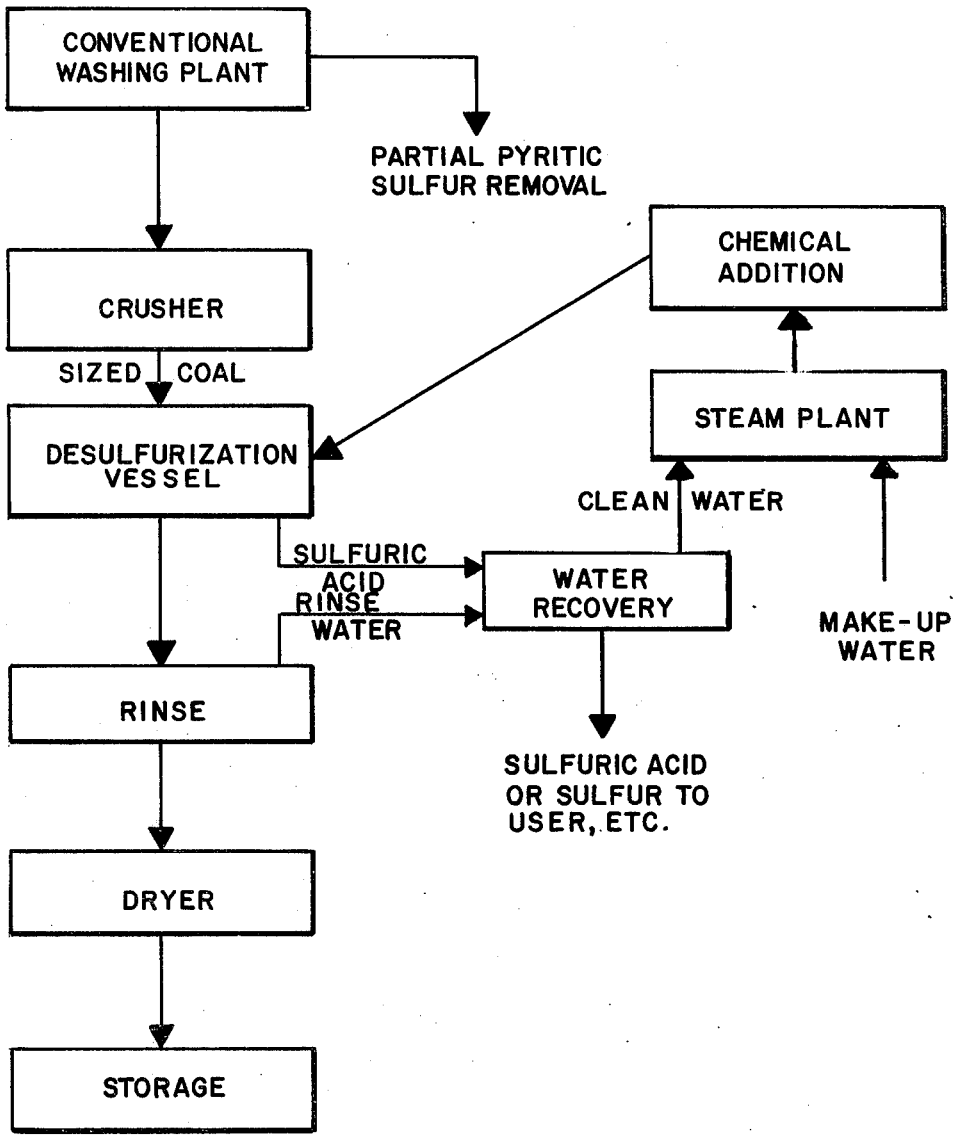
CONVENTIONAL WASHING PLANT
PARTIAL PYRITIC SULFUR REMOVAL
CHEMICAL ADDITION
CRUSHER
SIZED COAL
STEAM PLANT
DESULFURIZATION VESSEL
CLEAN WATER
SULFURIC ACID
RINSE WATER
WATER RECOVERY
MAKE-UP WATER
RINSE
SULFURIC ACID OR SULFUR TO USER, ETC.
DRYER
STORAGE

HYDRODESULFURIZATION OF COAL AND THE LIKE

BACKGROUND

The ever increasing demand for energy together with the desire to protect the environment from pollutants has resulted in considerable recent study of upgrading coal by removing sulfur therefrom. Coal as a fuel is an abundant source of energy comprising mostly carbon and small percentages of hydrogen, sulfur, and ash. When coal is burned to produce energy the presence of the sulfur and ash is generally undesirable. The sulfur and ash enter the atmosphere with the combustion products creating air pollution. While most of the ash can be prevented from entering the atmosphere little can be done with the sulfur. Hence, there is a desire for coals with a lower sulfur content. As a rule of thumb, coals are unacceptable if they contain more than about one percent sulfur. Unfortunately, many deposits of coal contain more than one percent sulfur usually present in the forms of pyrite, free sulfur and organic sulfur.

Numerous processes have been proposed for upgrading coal by sulfur removal. A portion of the sulfur can be removed by existing technology, namely, "coal washing." This process removes pyritic sulfur which exists in natural coal in the form of separate particles ranging from the very small to large nuggets. Approximately 30 to 80 percent of pyritic sulfur can be removed by washing, but usually this is not sufficient. The sulfur which cannot be removed by washing can only be removed by chemical processes. Generally speaking, there are three chemical coal desulfurization techniques disclosed in the prior art: (1) oxidation of the sulfur in the coal to form soluble sulfates; (2) reduction of the sulfur to elemental sulfur in which form it can be vaporized or removed by organic solvents; and (3) reaction with hydrogen to form gaseous hydrogen sulfide. Some processes are a combination of two of the above and some simply do not fit any of these classifications.

For any sulfur removal process to be practical it must be adaptable to the handling of large volumes of materials very economically. Hence, the reactants should be inexpensive and capable of being recycled and the apparatus should be rugged and simple.

DESCRIPTION OF THE PRIOR ART

An ancient U.S. Pat. No. 28,543 (issued in 1860) discloses a process for the removal of sulfur after coking wherein a mixture of sodium chloride, manganese peroxide, resin and water is applied to the red-hot coke and sulfur is oxidized and released from the coke mass in gaseous form. U.S. Pat. No. 3,993,455 teaches treating pulverized coal in an aqueous sodium or potassium hydroxide solution in an autoclave to remove pyritic sulfur.

SUMMARY OF THE INVENTION

Briefly, according to this invention coal or the like is desulfurized by contacting the coal with an aqueous solution of sodium chloride at moderately elevated temperatures and pressures, separating the coal from the sodium chloride solution and washing the coal with hot water.

THE DRAWING

The drawing is a flow diagram relating to a large scale implementation of the process according to this invention.

DETAILED DESCRIPTION OF THE INVENTION

According to this invention, raw coal is initially crushed or ground to a size which is easily handleable. It is preferable that the coal have a more or less uniform particle size. The coal is then introduced into a reaction vessel where it is boiled in an aqueous solution of sodium chloride. For improved liquid solids contact the content of the reaction vessel is slowly stirred. The pressure in the reaction vessel when sealed is, of course, directly related to the temperature of the vessel. The moderately elevated temperatures and pressures used in this process favor penetration of the solution, steam and gases present into the coal; yet, expensive heavy duty autoclaves are not required. It has been found that the conditions within the reaction vessel that bring about the greatest sulfur reduction vary for the particular type of coal being processed. Further, where the desulfurized coal is being used for coking, too high a pressure and temperature must be avoided or else the coking properties of the coal will be diminished. The concentration of sodium chloride may vary between wide limits depending upon the coal and the vessel conditions. The best concentration can be determined by simple testing with a starting point of about 40 parts by weight sodium chloride to 100 parts by weight water. The ratio of coal to sodium chloride solution is not critical but the solution should be present in sufficient amount to carry away all of the sulfur removed.

Analysis of waste liquors from applicant's process establishes that at the moderate temperatures employed, less than about 600° F., the components of the sodium chloride do not react to form additional compounds. Hence, the sodium chloride solution can be used over and over. It has also been found that by adding air to the reaction vessel sulfur removal is enhanced.

While applicant does not want to be tied to any particular theory of operation, it is believed that at least the following chemical reactions take place.

$$FeS_2 + H_2O + 7/2\ O_2 \rightarrow FeSO_4 + H_2SO_4$$

$$FeSO_4 + H_2SO_4 \rightarrow Fe(SO_4)_3 + H_2O$$

Both ferric sulfate and ferrous sulfate are water soluble. Since the solubility of ferric sulfate decreases with increasing temperature, some iron pyrite may be converted to insoluble ferric sulfate if the reaction vessel is allowed to become too hot.

Again, while not wanting to be tied to particular reactions, it is believed that sulfur dioxide is also formed in the reaction vessel which in turn results in sulfurous acid and sulfuric acid. The formation of these acids results in a reaction with the ash content of the coal resulting in a reduction in the ash content of the final product.

After the reaction period, which may be as little as five minutes, the treated coal is rinsed in hot water.

The following bench scale laboratory tests illustrate the effectiveness of the process according to this invention for removing sulfur, and to some degree ash, from raw coal.

EXAMPLE I

A sample of washed coal which had a sulfur content of 2.08 weight percent was processed as explained above. The coal was crushed to all pass ⅛ inch. Coal samples were removed from the reaction vessel at time intervals, the last sample at 15 minutes. The sulfur content of the samples are indicated in the following table:

| Sample | Sulfur Content |
|---|---|
| As received and washed | 2.08% |
| Sample 1 | 1.67 |
| Sample 2 | 1.58 |
| Sample 3 | .76 |
| Sample 4 (15 minutes) | .64 |
| Test Conditions: | |
| Temperature | In excess of boiling |
| Pressure | 15 psi |

EXAMPLE II

A sample of metallurgical coal was processed as explained above for Example I. The chemical analysis on a dry basis for coal before treatment and after treatment with different conditions is reported in the following table:

| | As Received | Treatment A | Treatment B |
|---|---|---|---|
| Ash | 10.16 | 10.37 | 6.42 |
| Volatile | 36.04 | 35.33 | 38.82 |
| Fixed Carbon | 53.80 | 54.30 | 54.76 |
| Sulfur | 2.00 | 1.79 | 1.58 |
| BTU valve | 13653 | 13685 | 14078 |
| FSI value | 8.0 | 8.0 | 7.5 |
| Test Conditions | | Treatment A | Treatment B |
| Temperature | | In excess of boiling | In excess of boiling |
| Pressure | | 15 psi | 140 psi |
| Reaction Time | | 15 minutes | 30 minutes |

Table II establishes that higher temperatures and pressures and longer times are required to reduce the sulfur content of certain coals.

EXAMPLE III

Another sample of very high sulfur coal was obtained and processed as explained above. The sulfur and ash contents are reported below.

| | As Received | After Treatment |
|---|---|---|
| Ash | 14.56% | 6.91% |
| Sulfur | 2.47 | 1.48 |
| Test Conditions | | |
| Temperature | | In excess of boiling |
| Pressure | | 140 psi |
| Treatment time | | 30 minutes |

The data set forth in the Tables of Examples I, II and III establish that the applicant's process is effective in removing sulfur from coal using inexpensive readily available reactants, namely, air, water and salt.

Referring now to the drawing, there is shown a flow diagram describing the large scale implementation of the process according to this invention. Raw coal may be first washed by conventional methods in order to remove solid rock and other waste material. The washing has the effect of removing a portion of the pyritic sulfur, thus reducing the sulfur loading in subsequent stages of the process. Thereafter, the cleaned coal is passed through a crusher where coal of a more or less uniform lump size is produced. From the crusher, the coal enters a desulfurization vessel, where under moderate pressure and temperature and in a brine solution, sulfur is removed from the coal. A weak sulfuric acid solution is produced which is passed to a water recovery stage wherein the sulfur is separated from the brine and the brine is recycled. A by-product of this process is sulfuric acid or sulfur. The coal is removed from the desulfurization vessel and rinsed with hot water. The rinse water is also returned to the water recovery stage. The recovered water or brine is returned to the steam plant where additional water and salt are added before returning to the desulfurization vessel. The rinsed coal is dried and stored.

This invention is applicable to fossil fuel or coal where the meaning of the terms includes, for example, anthracite, lignite, bituminous coal and so forth. The term sulfur as used in this application refers to any combination of free or chemically bound sulfur in the form of monosulfates and polysulfates and it also refers to chemically bound sulfur commonly known as pyrite.

Having thus described my invention with the detail and particularity as required by the Patent Laws, what is desired protected by Letters Patent is set forth in the following claims.

I claim:

1. A method of treating coal to reduce total sulfur content consisting of
   a. crushing and sizing the coal to a more or less homogenous size,
   b. combining the coal with a sodium chloride brine solution,
   c. heating the coal in the sodium chloride solution to at least the boiling point of water,
   d. holding the coal in the heated brine solution at a moderately elevated temperature and pressure for a period of time,
   e. removing the coal from the brine solution and washing with hot water, and
   f. recovering coal having a reduced sulfur and ash content.

2. The method as set forth in claim 1 wherein air is introduced into the reaction vessel.

3. The method according to claim 1 wherein the temperatures in the reaction vessel are not permitted to reach the temperatures at which the sodium chloride reacts with the other chemicals present in the reaction vessel.

4. The method according to claim 1 wherein the temperatures and pressures in reaction vessel are maintained sufficiently low such that the coal does not decompose resulting in diminished coking properties.

* * * * *